US011272740B2

(12) United States Patent
Lord

(10) Patent No.: US 11,272,740 B2
(45) Date of Patent: Mar. 15, 2022

(54) ELECTRONIC VAPOR PROVISION DEVICE

(71) Applicant: NICOVENTURES HOLDINGS LIMITED, London (GB)

(72) Inventor: Christopher Lord, London (GB)

(73) Assignee: NICOVENTURES HOLDINGS LIMITED, London (GB)

( * ) Notice: Subject to any disclaimer, the term of this patent is extended or adjusted under 35 U.S.C. 154(b) by 50 days.

(21) Appl. No.: 16/795,002

(22) Filed: Feb. 19, 2020

(65) Prior Publication Data

US 2020/0178604 A1 Jun. 11, 2020

Related U.S. Application Data

(63) Continuation of application No. 15/914,139, filed on Mar. 7, 2018, now Pat. No. 10,588,354, which is a continuation of application No. 14/415,552, filed as application No. PCT/EP2013/064952 on Jul. 15, 2013, now Pat. No. 9,943,108.

(30) Foreign Application Priority Data

Jul. 16, 2012 (GB) ..... 1212606

(51) Int. Cl.

| | |
|---|---|
| ***A24F 47/00*** | (2020.01) |
| ***A24F 40/46*** | (2020.01) |
| ***A24F 40/42*** | (2020.01) |
| ***A24F 40/44*** | (2020.01) |
| ***A24F 7/00*** | (2006.01) |
| *A24F 40/10* | (2020.01) |

(52) U.S. Cl.

CPC ..... *A24F 40/46* (2020.01); *A24F 7/00* (2013.01); *A24F 40/42* (2020.01); *A24F 40/44* (2020.01); *A24F 40/10* (2020.01)

(58) Field of Classification Search

CPC ..... A24F 40/46

See application file for complete search history.

(56) References Cited

U.S. PATENT DOCUMENTS

| | | | |
|---|---|---|---|
| 2,057,353 | A | 10/1936 | Whittemore |
| 2,809,634 | A | 10/1957 | Hirotada et al. |
| 2,937,648 | A | 5/1960 | Meyer |
| 2,991,788 | A | 7/1961 | Brost |
| 3,111,396 | A | 11/1963 | Ball |
| 3,148,996 | A | 9/1964 | Vukasovich et al. |
| 3,239,117 | A | 3/1966 | Letchworth |

(Continued)

FOREIGN PATENT DOCUMENTS

| | | | |
|---|---|---|---|
| AT | 508244 | A4 | 12/2010 |
| AU | 6393173 | A | 6/1975 |

(Continued)

OTHER PUBLICATIONS

CN 101843368-A Translation; Zhiping Chen (Year: 2010).*

(Continued)

*Primary Examiner* — Eric Yaary

(74) *Attorney, Agent, or Firm* — Patterson Thuente Pedersen, P.A.

(57) ABSTRACT

An electronic vapor provision device comprising a power cell, a vaporizer and a liquid store, wherein the vaporizer comprises a heater and a heater support, wherein the liquid store comprises a porous material.

15 Claims, 7 Drawing Sheets

(56) References Cited

U.S. PATENT DOCUMENTS 3,402,724 A 9/1968 Blount et al.
3,431,393 A 3/1969 Katsuda et al.
3,433,632 A 3/1969 Elbert et al.
3,521,643 A 7/1970 Toth et al.
3,604,428 A 9/1971 Moukaddem
3,804,100 A 4/1974 Fariello
3,844,199 A 10/1974 Block et al.
3,964,902 A 6/1976 Fletcher et al.
4,009,713 A 3/1977 Simmons et al.
4,031,906 A 6/1977 Knapp
4,094,119 A 6/1978 Sullivan
4,145,001 A 3/1979 Weyenberg et al.
4,161,283 A 7/1979 Hyman
4,193,513 A 3/1980 Bull, Jr.
4,219,031 A 8/1980 Rainer et al.
4,503,851 A 3/1985 Braunroth
4,588,976 A 5/1986 Jaselli
4,676,237 A 6/1987 Wood et al.
4,735,217 A 4/1988 Gerth et al.
4,827,950 A 5/1989 Banerjee et al.
4,830,028 A 5/1989 Lawson et al.
4,846,199 A 7/1989 Rose
4,848,374 A 7/1989 Chard et al.
4,885,129 A 12/1989 Leonard et al.
4,917,301 A 4/1990 Munteanu
4,922,901 A 5/1990 Brooks et al.
4,924,886 A 5/1990 Litzinger
4,947,874 A 8/1990 Brooks et al.
4,947,875 A 8/1990 Brooks et al.
4,978,814 A 12/1990 Honour
5,027,837 A 7/1991 Clearman et al.
5,046,514 A 9/1991 Bolt
5,060,671 A 10/1991 Counts et al.
5,065,776 A 11/1991 Lawson et al.
5,095,647 A 3/1992 Zobele et al.
5,095,921 A 3/1992 Losee et al.
5,099,861 A 3/1992 Clearman et al.
5,115,823 A 5/1992 Keritsis
5,121,881 A 6/1992 Lembeck
5,129,409 A 7/1992 White et al.
5,144,962 A 9/1992 Counts et al.
5,167,242 A 12/1992 Turner et al.
5,179,966 A 1/1993 Losee et al.
5,247,947 A 9/1993 Clearman et al.
5,322,075 A 6/1994 Deevi et al.
5,369,723 A 11/1994 Counts et al.
5,388,574 A 2/1995 Ingebrethsen
5,390,864 A 2/1995 Alexander
5,415,186 A 5/1995 Casey, III et al.
5,415,486 A 5/1995 Wouters et al.
5,479,948 A 1/1996 Counts et al.
5,497,792 A 3/1996 Prasad et al.
5,501,236 A 3/1996 Hill et al.
5,505,214 A 4/1996 Collins et al.
5,540,241 A 7/1996 Kim
5,553,791 A 9/1996 Alexander
5,611,360 A 3/1997 Tang
5,636,787 A 6/1997 Gowhari
5,649,554 A 7/1997 Sprinkel et al.
5,666,977 A 9/1997 Higgins et al.
5,692,291 A 12/1997 Deevi et al.
5,692,526 A 12/1997 Adams et al.
5,743,251 A 4/1998 Howell et al.
5,865,185 A 2/1999 Collins et al.
5,954,060 A 9/1999 Cardarelli
6,095,505 A 8/2000 Miller
6,155,268 A 12/2000 Takeuchi
6,275,650 B1 8/2001 Lambert
6,280,793 B1 8/2001 Atwell et al.
6,532,965 B1 3/2003 Abhulimen et al.
6,652,804 B1 11/2003 Neumann et al.
6,681,998 B2 1/2004 Sharpe et al.
6,701,921 B2 3/2004 Sprinkel, Jr. et al.
6,790,496 B1 9/2004 Levander et al.
7,100,618 B2 9/2006 Dominguez
7,112,712 B1 9/2006 Ancell
7,263,228 B2 8/2007 Mori
7,400,940 B2 7/2008 McRae et al.
7,540,286 B2 6/2009 Cross et al.
7,767,698 B2 8/2010 Warchol et al.
7,832,410 B2 11/2010 Hon
7,992,554 B2 8/2011 Radomski et al.
8,156,944 B2 4/2012 Han
8,205,622 B2 6/2012 Pan
8,365,742 B2 2/2013 Hon
8,375,957 B2 2/2013 Hon
8,393,331 B2 3/2013 Hon
8,430,106 B2 4/2013 Potter et al.
8,490,628 B2 7/2013 Hon
8,511,318 B2 8/2013 Hon
8,689,805 B2 4/2014 Hon
8,752,545 B2 6/2014 Buchberger
8,833,364 B2 9/2014 Buchberger
8,948,578 B2 2/2015 Buchberger
8,975,764 B1 3/2015 Abehasera
9,623,205 B2 4/2017 Buchberger
9,974,335 B2 5/2018 Lord
10,111,466 B2 10/2018 Lord
10,278,421 B2 5/2019 Lord
2001/0042546 A1 11/2001 Umeda et al.
2002/0016370 A1 2/2002 Shytle et al.
2002/0079309 A1 6/2002 Cox et al.
2003/0005620 A1 1/2003 Ananth et al.
2003/0049025 A1 3/2003 Neumann et al.
2003/0063902 A1 4/2003 Pedrotti et al.
2003/0079309 A1 5/2003 Vandenbelt et al.
2003/0106552 A1 6/2003 Sprinkel, Jr. et al.
2003/0200964 A1 10/2003 Blakley et al.
2004/0031485 A1 2/2004 Rustad et al.
2004/0065749 A1 4/2004 Kotary et al.
2004/0129793 A1 7/2004 Nguyen et al.
2005/0204799 A1 9/2005 Koch
2005/0268911 A1 12/2005 Cross et al.
2006/0078477 A1 4/2006 Althouse et al.
2006/0131439 A1 6/2006 Lakatos et al.
2007/0014549 A1 1/2007 Demarest et al.
2007/0062548 A1 3/2007 Horstmann et al.
2007/0102013 A1 5/2007 Adams et al.
2007/0107879 A1 5/2007 Radomski et al.
2007/0137667 A1 6/2007 Zhuang et al.
2007/0155255 A1 7/2007 Galauner et al.
2007/0283972 A1 12/2007 Monsees et al.
2008/0092912 A1 4/2008 Robinson et al.
2008/0216828 A1 9/2008 Wensley et al.
2008/0241255 A1 10/2008 Rose et al.
2009/0095311 A1 4/2009 Han
2009/0188490 A1 7/2009 Han
2009/0272379 A1 11/2009 Thorens et al.
2009/0288668 A1 11/2009 Inagaki
2009/0293888 A1 12/2009 Williams et al.
2009/0293892 A1 12/2009 Williams et al.
2009/0302019 A1 12/2009 Selenski et al.
2010/0006113 A1 1/2010 Urtsev et al.
2010/0024834 A1 2/2010 Oglesby et al.
2010/0059070 A1 3/2010 Potter et al.
2010/0065653 A1 3/2010 Wingo et al.
2010/0083959 A1 4/2010 Siller
2010/0108059 A1 5/2010 Axelsson et al.
2010/0236546 A1 9/2010 Yamada et al.
2011/0005535 A1 1/2011 Xiu
2011/0011396 A1 1/2011 Fang
2011/0036363 A1 2/2011 Urtsev et al.
2011/0094523 A1* 4/2011 Thorens ..... H05B 1/0244 131/194
2011/0126848 A1 6/2011 Zuber et al.
2011/0155153 A1 6/2011 Thorens et al.
2011/0168194 A1 7/2011 Hon
2011/0209717 A1* 9/2011 Han ..... H05B 3/42 131/273
2011/0226236 A1 9/2011 Buchberger
2011/0232654 A1 9/2011 Mass
2011/0277756 A1 11/2011 Terry et al.
2011/0277757 A1 11/2011 Terry et al.
2011/0290267 A1 12/2011 Yamada et al.

(56) References Cited

U.S. PATENT DOCUMENTS

| | | | |
|---|---|---|---|
| 2011/0297166 | A1 | 12/2011 | Takeuchi et al. |
| 2011/0303231 | A1 | 12/2011 | Li et al. |
| 2012/0006343 | A1 | 1/2012 | Renaud et al. |
| 2012/0111347 | A1 | 5/2012 | Hon |
| 2012/0145169 | A1 | 6/2012 | Wu |
| 2012/0179512 | A1 | 7/2012 | O'Keeffe |
| 2012/0227753 | A1 | 9/2012 | Newton |
| 2012/0234821 | A1 | 9/2012 | Shimizu |
| 2012/0255567 | A1 | 10/2012 | Rose et al. |
| 2012/0260927 | A1 | 10/2012 | Liu |
| 2012/0279512 | A1 | 11/2012 | Hon |
| 2012/0285475 | A1 | 11/2012 | Liu |
| 2012/0285476 | A1 | 11/2012 | Hon |
| 2013/0037041 | A1 | 2/2013 | Worm et al. |
| 2013/0056013 | A1 | 3/2013 | Terry et al. |
| 2013/0074857 | A1 | 3/2013 | Buchberger |
| 2013/0081619 | A1 | 4/2013 | Seakins et al. |
| 2013/0081623 | A1 | 4/2013 | Buchberger |
| 2013/0192615 | A1 | 8/2013 | Tucker et al. |
| 2013/0192623 | A1 | 8/2013 | Tucker et al. |
| 2013/0213417 | A1 | 8/2013 | Chong et al. |
| 2013/0213419 | A1 | 8/2013 | Tucker et al. |
| 2013/0284192 | A1 | 10/2013 | Peleg et al. |
| 2013/0298905 | A1 | 11/2013 | Levin et al. |
| 2013/0306085 | A1 | 11/2013 | Sanchez et al. |
| 2013/0333700 | A1 | 12/2013 | Buchberger |
| 2013/0340779 | A1 | 12/2013 | Liu |
| 2014/0000638 | A1 | 1/2014 | Sebastian et al. |
| 2014/0007863 | A1 | 1/2014 | Chen |
| 2014/0024834 | A1 | 1/2014 | Mergelsberg et al. |
| 2014/0060528 | A1 | 3/2014 | Liu |
| 2014/0060529 | A1 | 3/2014 | Zhang |
| 2014/0060554 | A1 | 3/2014 | Collett et al. |
| 2014/0060555 | A1 | 3/2014 | Chang et al. |
| 2014/0069444 | A1 | 3/2014 | Cyphert et al. |
| 2014/0202454 | A1 | 7/2014 | Buchberger |
| 2014/0209105 | A1 | 7/2014 | Sears et al. |
| 2014/0238396 | A1 | 8/2014 | Buchberger |
| 2014/0238423 | A1 | 8/2014 | Tucker et al. |
| 2014/0238424 | A1 | 8/2014 | Macko et al. |
| 2014/0261490 | A1 | 9/2014 | Kane |
| 2014/0270730 | A1 | 9/2014 | DePiano et al. |
| 2014/0283825 | A1 | 9/2014 | Buchberger |
| 2014/0286630 | A1 | 9/2014 | Buchberger |
| 2014/0299125 | A1 | 10/2014 | Buchberger |
| 2014/0299142 | A1 | 10/2014 | Dincer et al. |
| 2014/0338680 | A1 | 11/2014 | Abramov et al. |
| 2015/0020831 | A1 | 1/2015 | Weigensberg et al. |
| 2015/0114411 | A1 | 4/2015 | Buchberger |
| 2015/0150302 | A1 | 6/2015 | Metrangolo et al. |
| 2015/0157055 | A1 | 6/2015 | Lord |
| 2015/0196058 | A1 | 7/2015 | Lord |
| 2015/0201675 | A1 | 7/2015 | Lord |
| 2015/0208728 | A1 | 7/2015 | Lord |
| 2015/0245654 | A1 | 9/2015 | Memari et al. |
| 2015/0258288 | A1 | 9/2015 | Sullivan |
| 2015/0333552 | A1 | 11/2015 | Alarcon |
| 2015/0333561 | A1 | 11/2015 | Alarcon |
| 2016/0073693 | A1 | 3/2016 | Reevell |
| 2016/0106154 | A1 | 4/2016 | Lord |
| 2016/0106155 | A1 | 4/2016 | Reevell |
| 2016/0250201 | A1 | 9/2016 | Rose et al. |
| 2016/0278436 | A1 | 9/2016 | Verleur et al. |
| 2016/0295923 | A1 | 10/2016 | Lin |
| 2016/0353804 | A1 | 12/2016 | Lord |
| 2017/0042245 | A1 | 2/2017 | Buchberger et al. |
| 2017/0114965 | A1 | 4/2017 | Maglica et al. |
| 2017/0143042 | A1 | 5/2017 | Batista et al. |
| 2017/0173278 | A1 | 6/2017 | Buchberger |
| 2017/0197043 | A1 | 7/2017 | Buchberger |
| 2017/0197044 | A1 | 7/2017 | Buchberger |
| 2017/0197046 | A1 | 7/2017 | Buchberger |
| 2017/0208865 | A1 | 7/2017 | Nettenstrom et al. |
| 2017/0251725 | A1 | 9/2017 | Buchberger et al. |
| 2018/0192705 | A1 | 7/2018 | Lord |
| 2018/0199618 | A1 | 7/2018 | Fuisz et al. |
| 2018/0235284 | A1 | 8/2018 | Lord |
| 2021/0100285 | A1 | 4/2021 | Spencer et al. |

FOREIGN PATENT DOCUMENTS

| | | | | |
|---|---|---|---|---|
| CA | 2309376 | A1 | | 11/2000 |
| CA | 2864238 | A1 | | 8/2013 |
| CH | 698603 | B1 | | 9/2009 |
| CN | 1040496 | A | | 3/1990 |
| CN | 2082939 | U | | 8/1991 |
| CN | 2092880 | U | | 1/1992 |
| CN | 2220168 | Y | | 2/1996 |
| CN | 2249068 | Y | | 3/1997 |
| CN | 1205849 | A | | 1/1999 |
| CN | 2719043 | Y | | 8/2005 |
| CN | 1925757 | A | | 3/2007 |
| CN | 201054977 | Y | | 5/2008 |
| CN | 201079011 | Y | | 7/2008 |
| CN | 101277623 | A | | 10/2008 |
| CN | 201238609 | Y | | 5/2009 |
| CN | 101500443 | A | | 8/2009 |
| CN | 201375023 | Y | | 1/2010 |
| CN | 201379072 | Y | | 1/2010 |
| CN | 201468000 | U | | 5/2010 |
| CN | 101795505 | A | | 8/2010 |
| CN | 101843368 | A | * | 9/2010 |
| CN | 101878958 | A | | 11/2010 |
| CN | 202085723 | U | | 12/2011 |
| CN | 202172846 | U | | 3/2012 |
| CN | 102655773 | A | | 9/2012 |
| CN | 202722498 | U | | 2/2013 |
| CN | 202750708 | U | | 2/2013 |
| CN | 103070472 | A | | 5/2013 |
| CN | 203168033 | U | | 9/2013 |
| CN | 103750573 | A | | 4/2014 |
| CN | 103929988 | A | | 7/2014 |
| CN | 103974369 | A | | 8/2014 |
| CN | 103974639 | A | | 8/2014 |
| CN | 104095293 | A | | 10/2014 |
| CN | 203943069 | U | | 11/2014 |
| CN | 204120237 | U | | 1/2015 |
| CN | 104349687 | A | | 2/2015 |
| CN | 106102863 | A | | 11/2016 |
| DE | 822964 | C | | 11/1951 |
| DE | 1950439 | A1 | | 4/1971 |
| DE | 3148335 | A1 | | 7/1983 |
| DE | 3218760 | A1 | | 12/1983 |
| DE | 3844022 | C1 | | 2/1990 |
| DE | 3936687 | A1 | | 5/1990 |
| DE | 29713866 | U1 | | 10/1997 |
| DE | 19630619 | A1 | | 2/1998 |
| DE | 19654945 | A1 | | 3/1998 |
| DE | 10330681 | B3 | | 6/2004 |
| DE | 202006013439 | U1 | | 10/2006 |
| DE | 102006004484 | A1 | | 8/2007 |
| DE | 102007011120 | A1 | | 9/2008 |
| DE | 202013100606 | U1 | | 2/2013 |
| EA | 015651 | B1 | | 10/2011 |
| EA | 201100197 | A1 | | 3/2012 |
| EP | 0280262 | A2 | | 8/1988 |
| EP | 0295122 | A2 | | 12/1988 |
| EP | 0358002 | A2 | | 3/1990 |
| EP | 0444553 | A2 | | 9/1991 |
| EP | 0488488 | A1 | | 6/1992 |
| EP | 0532194 | A1 | | 3/1993 |
| EP | 0712584 | A2 | | 5/1996 |
| EP | 0845220 | A1 | | 6/1998 |
| EP | 0893071 | A1 | | 1/1999 |
| EP | 1166814 | A2 | | 1/2002 |
| EP | 1166847 | A2 | | 1/2002 |
| EP | 1283062 | A1 | | 2/2003 |
| EP | 0845220 | B1 | | 9/2003 |
| EP | 1486226 | A2 | | 12/2004 |
| EP | 1736065 | A1 | | 12/2006 |
| EP | 2018886 | A1 | | 1/2009 |
| EP | 2022349 | A1 | | 2/2009 |
| EP | 1736065 | B1 | | 6/2009 |
| EP | 2113178 | A1 | | 11/2009 |

(56) References Cited

FOREIGN PATENT DOCUMENTS

| | | | |
|---|---|---|---|
| EP | 2119375 | A1 | 11/2009 |
| EP | 2327318 | A1 | 6/2011 |
| EP | 2340729 | A1 | 7/2011 |
| EP | 2394520 | A1 | 12/2011 |
| EP | 2404515 | A1 | 1/2012 |
| EP | 2444112 | A1 | 4/2012 |
| EP | 2444411 | A1 | 4/2012 |
| EP | 2695531 | A1 | 2/2014 |
| EP | 2698070 | A1 | 2/2014 |
| EP | 2762019 | A1 | 8/2014 |
| EP | 2835062 | A1 | 2/2015 |
| EP | 2939553 | A1 | 11/2015 |
| EP | 2083643 | B1 | 9/2017 |
| FR | 960469 | A | 4/1950 |
| GB | 25575 | A | 3/1912 |
| GB | 1313525 | A | 4/1973 |
| GB | 2333466 | A | 7/1999 |
| GB | 2488257 | A | 8/2012 |
| GB | 2496105 | A | 5/2013 |
| HK | 1196511 | A | 10/2016 |
| HK | 1226611 | | 10/2017 |
| JP | S5130900 | U | 3/1976 |
| JP | S5752456 | A | 3/1982 |
| JP | S59106340 | A | 6/1984 |
| JP | S6196763 | A | 5/1986 |
| JP | S6196765 | A | 5/1986 |
| JP | H02124081 | A | 5/1990 |
| JP | H0339077 | A | 2/1991 |
| JP | H05103836 | A | 4/1993 |
| JP | H05309136 | A | 11/1993 |
| JP | H06315366 | A | 11/1994 |
| JP | H07502188 | A | 3/1995 |
| JP | H0878142 | A | 3/1996 |
| JP | H08299862 | A | 11/1996 |
| JP | H1189551 | A | 4/1999 |
| JP | H11507234 | A | 6/1999 |
| JP | 2002527153 | A | 8/2002 |
| JP | 3392138 | B2 | 3/2003 |
| JP | 2004332069 | A | 11/2004 |
| JP | 2005537918 | A | 12/2005 |
| JP | 2006504431 | A | 2/2006 |
| JP | 2007259864 | A | 10/2007 |
| JP | 2007267749 | A | 10/2007 |
| JP | 2009502136 | A | 1/2009 |
| JP | 2009504431 | A | 2/2009 |
| JP | 3153675 | U | 9/2009 |
| JP | 2009537119 | A | 10/2009 |
| JP | 2010520742 | A | 6/2010 |
| JP | 3164992 | U | 12/2010 |
| JP | 2011518567 | A | 6/2011 |
| JP | 2012517229 | A | 8/2012 |
| JP | 5130900 | B2 | 1/2013 |
| JP | 2013545473 | A | 12/2013 |
| JP | 2014076065 | A | 5/2014 |
| JP | 2014525237 | A | 9/2014 |
| JP | 2015524257 | A | 8/2015 |
| KR | 20110006928 | A | 1/2011 |
| KR | 20110006928 | U | 7/2011 |
| KR | 101081481 | B1 | 11/2011 |
| RU | 2004116065 | A | 6/2005 |
| RU | 2311859-02 | | 12/2007 |
| RU | 2336001 | C2 | 10/2008 |
| RU | 89927 | U1 | 12/2009 |
| RU | 94815 | U1 | 6/2010 |
| RU | 103281 | U1 | 4/2011 |
| RU | 2420290 | C2 | 6/2011 |
| RU | 110608 | U1 | 11/2011 |
| RU | 115629 | U1 | 5/2012 |
| RU | 122000 | U1 | 11/2012 |
| RU | 124120 | U1 | 1/2013 |
| RU | 2480485 | C2 | 4/2013 |
| RU | 145715 | U1 | 9/2014 |
| RU | 158129 | U1 | 12/2015 |
| SU | 1641182 | A3 | 4/1991 |
| TW | 201225862 | A | 7/2012 |
| WO | WO-9406313 | A1 | 3/1994 |
| WO | WO-9502712 | A2 | 1/1995 |
| WO | WO-9527412 | A1 | 10/1995 |
| WO | WO-9632854 | A2 | 10/1996 |
| WO | WO-9639880 | A1 | 12/1996 |
| WO | WO-9748293 | A1 | 12/1997 |
| WO | WO-9836651 | A1 | 8/1998 |
| WO | WO-0009188 | A1 | 2/2000 |
| WO | WO-0021598 | A1 | 4/2000 |
| WO | WO-02058747 | A1 | 8/2002 |
| WO | WO-03028409 | A1 | 4/2003 |
| WO | WO-03050405 | A1 | 6/2003 |
| WO | WO-03083283 | A1 | 10/2003 |
| WO | WO-03101454 | A1 | 12/2003 |
| WO | WO-2004022128 | A2 | 3/2004 |
| WO | WO-2004022242 | A1 | 3/2004 |
| WO | WO-2004022243 | A1 | 3/2004 |
| WO | WO-2004080216 | A1 | 9/2004 |
| WO | WO-2005106350 | A2 | 11/2005 |
| WO | WO-2006048774 | A1 | 5/2006 |
| WO | WO-2006082571 | A1 | 8/2006 |
| WO | WO-2007012007 | A2 | 1/2007 |
| WO | WO-2007042941 | A2 | 4/2007 |
| WO | WO-2007078273 | A1 | 7/2007 |
| WO | WO-2007131449 | A1 | 11/2007 |
| WO | WO-2008015441 | A1 | 2/2008 |
| WO | WO-2008029381 | A2 | 3/2008 |
| WO | WO-2009015410 | A1 | 2/2009 |
| WO | WO-2009022232 | A2 | 2/2009 |
| WO | WO-2009132793 | A1 | 11/2009 |
| WO | WO-2010045670 | A1 | 4/2010 |
| WO | WO-2010045671 | A1 | 4/2010 |
| WO | WO-2010091593 | A1 | 8/2010 |
| WO | WO-2011060788 | A1 | 5/2011 |
| WO | WO-2011079932 | A1 | 7/2011 |
| WO | WO-2011106788 | A2 | 9/2011 |
| WO | WO-2011107737 | A1 | 9/2011 |
| WO | WO-2011109849 | A1 | 9/2011 |
| WO | WO-2011124033 | A1 | 10/2011 |
| WO | WO-2011137453 | A2 | 11/2011 |
| WO | WO-2011146372 | A2 | 11/2011 |
| WO | WO-2011160788 | A1 | 12/2011 |
| WO | WO-2012025496 | A1 | 3/2012 |
| WO | WO-2012072762 | A1 | 6/2012 |
| WO | WO-2012156700 | A1 | 11/2012 |
| WO | WO-2013034453 | A1 | 3/2013 |
| WO | WO-2013034460 | A1 | 3/2013 |
| WO | WO-2013057185 | A1 | 4/2013 |
| WO | WO-2013060784 | A2 | 5/2013 |
| WO | WO-2013076098 | A2 | 5/2013 |
| WO | WO-2013082173 | A1 | 6/2013 |
| WO | WO-2013083631 | A1 | 6/2013 |
| WO | WO-2013083634 | A1 | 6/2013 |
| WO | WO-2013098395 | A1 | 7/2013 |
| WO | WO-2013116558 | A1 | 8/2013 |
| WO | WO-2013116571 | A1 | 8/2013 |
| WO | WO-2013148810 | A1 | 10/2013 |
| WO | WO-2013149404 | A1 | 10/2013 |
| WO | WO-2013178766 | A1 | 12/2013 |
| WO | WO-2014061477 | A1 | 4/2014 |
| WO | WO-2014104078 | A1 | 7/2014 |
| WO | WO-2014106093 | A1 | 7/2014 |
| WO | WO-2014130695 | A1 | 8/2014 |
| WO | WO-2014136872 | A1 | 9/2014 |
| WO | WO-2014140320 | A1 | 9/2014 |
| WO | WO-2014150131 | A1 | 9/2014 |
| WO | WO-2015117702 | A1 | 8/2015 |
| WO | WO-2016156493 | A2 | 10/2016 |
| WO | WO-2016162446 | A1 | 10/2016 |
| WO | WO-2017055866 | A1 | 4/2017 |

OTHER PUBLICATIONS

Aerosols, "Pulmonary Pharmacology: Delivery Devices and Medications," Sep. 6, 2017, available at www.cdeu.org/cecourses/z98207/ch4.html, 2 pages.

Application and File History for U.S. Appl. No. 14/415,540, filed Jan. 16, 2015, Inventor: Lord, 522 pages.

(56) References Cited

OTHER PUBLICATIONS

Application and File History for U.S. Appl. No. 14/415,552, filed Jan. 16, 2015, Inventor: Christopher Lord, 382 pages.
Application and File History for U.S. Appl. No. 15/563,065, filed Sep. 29, 2017, 471 pages, Inventor: Sutton.
Application and File History for U.S. Appl. No. 15/563,078, filed Sep. 29, 2017, 413 pages, Inventor: Sutton.
Application and File History for U.S. Appl. No. 15/563,086, filed Sep. 29, 2017, 433 pages, Inventor: Sutton.
Application and File History for U.S. Appl. No. 15/914,139, filed Mar. 7, 2018, 245 pages, Inventor: Lord et al.
Application and File History for U.S. Appl. No. 15/959,687, filed Apr. 23, 2018, 200 pages, Inventor: Christopher Lord.
Cambridge Dictionary, "Definition of Sleeve", dictionary/Cambridge.org/dictionary/English/sleeve, Feb. 9, 2019, 1 page.
Communication pursuant to Article 94(3) EPC for European Application No. 16189742.6, dated Dec. 4, 2020, 9 pages.
Decision to Grant dated Apr. 6, 2016 for Russian Application No. 2015100881, 8 Pages.
Decision to Grant dated Oct. 24, 2019 for Russian Application No. 2019118770, 11 pages.
Decision to Grant dated Sep. 19, 2016 for Russian Application No. 2015100878, 12 pages.
Diener Electronic, "Plasma Polymerization," The company Diener electronic GmbH+Co. KG, Retrieved on Oct. 17, 2017, 19 pages.
Dunn P.D., et al., "Heat Pipes," Fourth Edition, Pergamon, ISBN0080419038, 1994, 14 pages.
Exam Report from European Application 16189742.6-1006, dated Dec. 19, 2019, 8 pages.
Examination Report for Australian Application No. 2015293686, dated Jul. 25, 2018, 6 pages.
Examination Report for European Application No. 15741289.1, dated Jun. 15, 2018, 6 pages.
Extended European Search Report for Application No. 15178588, dated Apr. 14, 2016, 2 pages.
Extended European Search Report for Application No. 16166656, dated Oct. 11, 2016, 9 pages.
Extended European Search Report for Application No. 16177005.2, dated Oct. 26, 2016, 7 pages.
Extended European Search Report for Application No. 17189951.1, dated Jan. 4, 2018, 11 pages.
Extended European Search Report for Application No. EP16189742.6, dated Mar. 17, 2017, 7 pages.
Extended European Search Report for European Application No. EP19174777.3, dated Nov. 11, 2019, 7 pages.
Extended Search Report for European Application No. 18195423.1, dated Jan. 29, 2019, 11 pages.
First Office Action dated Dec. 3, 2012 for Chinese Application No. 200980152395.4, 16 pages.
International Preliminary Report on Patentability for Application No. PCT/EP2016/057060, dated Jul. 12, 2017, 8 pages.
International Preliminary Report on Patentability for Application No. PCT/EP2016/057097, dated Oct. 12, 2017, 10 pages.
International Search Report and Written Opinion for Application No. PCT/EP2016/057097, dated Sep. 28, 2016, 14 pages.
International Preliminary Report on Patentability for Appl. No. PCT/EP2016/057064, dated Oct. 12, 2017, 10 pages.
International Preliminary Report on Patentability for Application No. PCT/AT2012/000017, dated Aug. 13, 2013, 5 pages.
International Preliminary Report on Patentability for Application No. PCT/EP2012/070647, dated Apr. 22, 2014, 8 pages.
International Preliminary Report on Patentability for Application No. PCT/EP2013/064950, dated Oct. 31, 2014, 12 pages.
International Preliminary Report on Patentability for Application No. PCT/EP2013/064952, dated Oct. 27, 2014, 9 pages.
International Preliminary Report on Patentability for Application No. PCT/GB2014/051332, dated Nov. 12, 2015, 7 pages.
International Preliminary Report on Patentability for Application No. PCT/GB2014/051333, dated Aug. 5, 2015, 12 pages.
International Preliminary Report on Patentability for Application No. PCT/GB2014/051334, dated Nov. 12, 2015, 7 pages.
International Preliminary Report on Patentability for Application No. PCT/GB2015/051213, dated Jul. 14, 2016, 20 pages.
International Search Report and Written Opinion for Application No. PCT/AT2012/000017, dated Jul. 3, 2012, 6 pages.
International Search Report and Written Opinion for Application No. PCT/EP2012/003103, dated Nov. 26, 2012, 6 pages.
International Search Report and Written Opinion for Application No. PCT/EP2012/070647, dated Feb. 6, 2013, 9 pages.
International Search Report and Written Opinion for Application No. PCT/EP2013/064950, dated Dec. 2, 2013.
International Search Report and Written Opinion for Application No. PCT/EP2013/064952, dated Oct. 11, 2013, 7 pages.
International Search Report and Written Opinion for Application No. PCT/EP2016/057064, dated Oct. 19, 2016, 15 pages.
International Search Report and Written Opinion for Application No. PCT/GB2014/051332, dated Jul. 21, 2014, 8 pages.
International Search Report and Written Opinion for Application No. PCT/GB2014/051333, dated Jul. 17, 2014, 10 pages.
International Search Report and Written Opinion for Application No. PCT/GB2014/051334, dated Jul. 21, 2014, 8 pages.
International Search Report and Written Opinion dated Dec. 2, 2013, for Application No. PCT/EP2013/064950 filed Jul. 15, 2013, 7 pages.
International Search Report for Application No. PCT/AT2009/000413, dated Jan. 25, 2010, 3 pages.
International Search Report for Application No. PCT/AT2009/000414, dated Jan. 26, 2010, 2 pages.
International Search Report for Application No. PCT/EP2016/057060, dated Sep. 28, 2016, 7 pages.
International Search Report for Application No. PCT/GB2015/051213, dated Jul. 16, 2015, 5 pages.
Korean Decision for Refusal for Korean Application No. KR2020110006928 dated Jan. 10, 2019.
Korean Notice of Trial Decision, IP Trial and Appeal Board, the 10'th Bureau, Trial Decision, Trial No. 2017 won 5687, mailed Aug. 14, 2019, 17 pages.
KR 101081481 Translation; Kim Hyung Yoon; Nov. 2011,6 pages.
Kynol, "Standard Specifications of Kynol™ Activated Carbon Fiber Products," Sep. 19, 2013, 2 pages.
Notice of Opposition for European Patent No. EP2871984 dated Jun. 5, 2017, 17 pages.
Notice of Opposition Letter from EPO Opposition against the European Application No. 2358418, dated Mar. 1, 2017, 60 pages.
Notice of Reasons for Rejection dated Oct. 15, 2013 for Japanese Application No. 2011532464, 6 pages.
Notice of Reasons for Rejection dated May 23, 2017 for Japanese Application No. 2016134648, 18 pages.
Notice of Reasons for Rejection dated May 31, 2016 for Japanese Application No. 2015-137361, 6 pages.
Notice of Reasons for Rejection dated Sep. 8, 2015 for Japanese Application No. 2014179732, 5 pages.
Office Action and Search Report dated Jun. 21, 2019 for Chinese Application No. 201680020842.0, 25 pages.
Office Action and Search Report dated Jul. 23, 2019 for Chinese Application No. CN201680020758.9, 21 pages.
Office Action and Search Report dated Jun. 24, 2019 for Chinese Application No. CN201680020844.X, 22 pages.
Office Action dated Apr. 18, 2016 for Chinese Application No. 201380038055.5, 9 pages.
Office Action dated Aug. 24, 2018 for Chinese Application No. 201580040255.3, 8 pages.
Office Action for Canadian Application No. 2,878,959, dated Jan. 18, 2016, 6 pages.
Office Action for Canadian Application No. 2,878,973, dated Jan. 22, 2016, 6 pages.
Office Action for Canadian Application No. 2,954,848, dated Dec. 18, 2017, 4 pages.
Office Action for Chinese Application No. 201380038055.5, dated Jul. 11, 2017, 3 pages.
Office Action For Chinese Application No. 201811153475.9, dated Apr. 22, 2021, 17 pages.

(56) References Cited

OTHER PUBLICATIONS

Office Action for Japanese Application No. 2015-522064, dated Dec. 28, 2015, 2 pages.
Office Action for Japanese Application No. 2015-522065, dated Jan. 5, 2016, 2 pages.
Office Action for Japanese Application No. 2015-522066, dated Dec. 8, 2015, 3 pages.
Office Action for Japanese Application No. 2015-522066, dated Jan. 5, 2016. 2 pages.
Office Action for Japanese Application No. 2017-504040, dated Feb. 22, 2018, 7 pages.
Office Action for Japanese Application No. 2017-504040, dated Oct. 9, 2018, 2 pages (5 pages with translation).
Office Action for Japanese Application No. 2017-551206, dated Oct. 23, 2019, 8 pages.
Office Action for Japanese Application No. 2018-206299, dated Apr. 13, 2021,7 pages.
Office Action for Japanese Application No. 2018-206299, dated Oct. 6, 2020, 9 pages.
Office Action for Japanese Application No. 2019-124231, dated Oct. 27, 2020, 8 pages.
Office Action For Russian Application No. 2020124363, dated Feb. 17, 2021, 3 pages.
Office Action dated Jul. 2, 2019 for Chinese Application No. 201680020844.X, 22 pages.
Office Action dated Oct. 2, 2018, for Japanese Application No. 2017-551205, 11 pages.
Office Action dated Jan. 5, 2015 for Japanese Application No. 2015-522064, 2 pages.
Office Action dated Aug. 6, 2019 for Japanese Application No. 2017-551218,16 pages(Including Translation).
Office Action dated Sep. 11, 2017 for Chinese Application No. 201480024988.3, 10 pages.
Office Action dated Jan. 18, 2017 for Chinese Application No. 201480024978.X, 8 pages.
Office Action dated May 22, 2020 for Chinese Application No. 201680020844.X, 21 pages.
Office Action dated Sep. 22, 2017 for Russian Application No. 2014120213, 11 pages.
Office Action dated Oct. 26, 2016 for Russian Application No. 2014120213, 7 pages.
Office Action dated Dec. 30, 2016 for Chinese Application No. 201480024988.3, 26 pages.
Office Action dated Oct. 30, 2018 for Japanese Application No. 2017-551218, 4 pages.
Office Action dated Jul. 18, 2018 for Korean Application No. 10-2017-7034160, 8 pages (16 pages including Translation).
Office Action dated Mar. 15, 2018 for Korean Application No. 2017-7002235, 14 pages.
Office Action dated Sep. 7, 2016, for Korean Application No. 10-2015-7001256, 11 pages.
Office Action dated Sep. 8, 2016, for Korean Application No. 10-2015-7001257, 15 pages.
Office Action dated Sep. 24, 2018 for Russian Application No. 2018118998, 6 pages.
Rudolph G., "The Influence of CO2 on the Sensory Characteristics of the Favor-System," 1987, Accessed at http://legacy.library.ucsf.edu/tid/sld5f100, 24 pages.
Search Report dated Oct. 7, 2015 for corresponding GB Application No. 15505597.3, 3 pages.
Search Report dated May 17, 2020 for Chinese Application No. 201680020844.X, 4 pages.
Search Report dated Oct. 20, 2015 for Great Britain Application No. GB1505595.7, 4 pages.
Search Report dated Sep. 22, 2015 for Great Britain Application No. GB1505593.2, 6 pages.
Search Report dated Apr. 24, 2017 for Russian Application No. 2015146843, 3 pages.
Search Report dated Jan. 15, 2018, for Japanese Application No. 2017-504040, 8 pages (15 pages with translation).
Search Report dated Oct. 7, 2015 for Great Britain Application No. GB1505597.3, 3 pages.
Second Office Action dated Aug. 20, 2013 for Chinese Application No. 200980152395.4, 16 pages.
Written Opinion for Application No. PCT/EP2016/057060, dated Sep. 28, 2016, 8 pages.
Written Opinion for International Application No. PCT/EP2016/057060, dated Apr. 7, 2017, 6 pages.
Written Opinion of the International Preliminary Examining Authority for International Application No. PCT/GB2015/051213, dated Mar. 29, 2016, 9 pages.

* cited by examiner

ELECTRONIC VAPOR PROVISION DEVICE

RELATED APPLICATION

This application is a continuation of application Ser. No. 15/914,139 filed Mar. 7, 2018, which in turn is a continuation of application Ser. No. 14/415,552 filed Jan. 16, 2015, which is a National Phase entry of PCT Application No. PCT/EP2013/064952, filed Jul. 15, 2013 which claims the benefit of GB Application No. GB1212606.6 filed Jul. 16, 2012, each of which is fully incorporated herein by reference.

TECHNICAL FIELD

The specification relates to electronic vapor provision devices.

BACKGROUND

Electronic vapor provision devices are typically cigarette-sized and typically function by allowing a user to inhale a nicotine vapor from a liquid store by applying a suction force to a mouthpiece. Some electronic vapor provision devices have an airflow sensor that activates when a user applies the suction force and causes a heater coil to heat up and vaporize the liquid. Electronic vapor provision devices include electronic cigarettes.

SUMMARY

In an embodiment there is provided an electronic vapor provision device comprising a heating element for vaporizing liquid; an air outlet for vaporized liquid from the heating element; and a porous heating element support. The heating element support can be a store of liquid and have an internal channel having a circular cross-sectional shape, whereby the heating element can be fitted into the internal channel and be in contact with a surface of the internal channel along the length of the internal channel.

BRIEF DESCRIPTION OF THE DRAWINGS

For a better understanding of the disclosure, and to show how example embodiments may be carried into effect, reference will now be made to the accompanying drawings in which.

DETAILED DESCRIPTION

Figure 1:
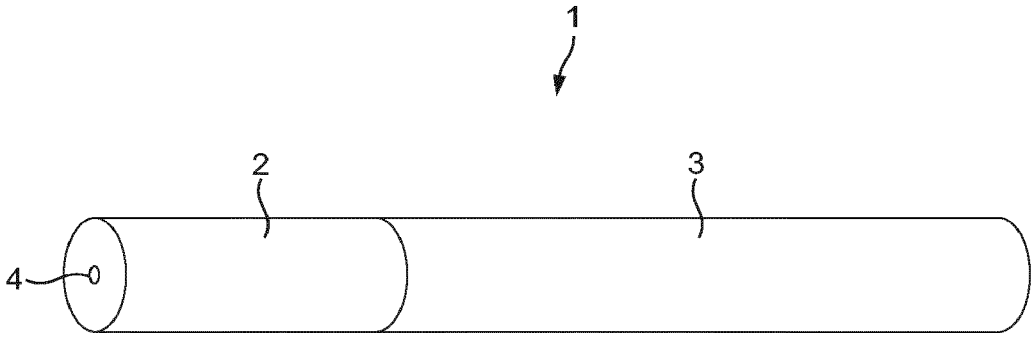
FIG. 1 is a side perspective view of an electronic cigarette.

In an embodiment there is provided an electronic vapor provision device comprising a power cell, a vaporizer and a liquid store, where the vaporizer comprises a heating element and a heating element support, wherein the liquid store comprises a porous material. The electronic vapor provision device may be an electronic cigarette. By having a liquid store comprising porous material, the liquid can be retained more efficiently, and also release and storage of the liquid is more controlled through the wicking action of the porous material.

The liquid store may comprise a solid porous material or a rigid porous material. For example, the liquid store may comprise a porous ceramic material. A solid porous material is advantageous since it is not open to deformation so the properties can be set and maintained. The shape can be defined at the manufacturing stage and this specific shape can be retained in the device to give consistency in device usage.

The liquid store may not comprise an outer liquid store container. Providing a solid porous material removes the need for an outer liquid store container and therefore gives a more efficient storage means.

The porous material may be optimized for liquid retention and wicking and/or for liquid glycerine retention and wicking. Moreover, the porous material may have pores of substantially equal size. The porous material may comprise pores distributed evenly throughout the material. Moreover, the porous material may be configured such that the majority of the material volume comprises open pores for liquid storage. The liquid store may be sealed on at least part of an outer surface region to inhibit porosity in that region.

The porous material may have smaller pores in a region next to the heating element and larger pores further from the heating element. The porous material may have a gradient of pore sizes ranging from smaller pores next to the heating element to larger pores further from the heating element.

The liquid store may be configured to wick liquid onto the heating element. The configuration of pores acts to determine the wicking effect of the storage medium, such that a more efficient means of transmission of liquid onto the heating element can be achieved.

The heating element support may form part of the liquid store, a separate additional liquid store or the entirety of the liquid store. By removing the requirement for a separate support, the number of components is reduced giving a simpler and cheaper device and enabling a larger liquid store to be used for increased capacity.

The heating element may be supported from its outside by the heating element support. Alternatively or additionally, the heating element may be supported from its inside by the heating element support.

One or more gaps may be provided between the heating element and the heating element support. Providing a gap between the heating element and the heating element support allows liquid to be gathered and stored in the gap region for vaporization. The gap can also act to wick liquid onto the heating element. Also, providing a gap between the heating element and support means that a greater surface area of the heating element is exposed thereby giving a greater surface area for heating and vaporization.

The heating element may be a heating coil, such as a wire coil. The heating coil may be coiled so as to be supported along its length by the heating element support. Moreover, the turns of the heating coil may be supported by the heating element support. For example, the turns of the heating coil may be in contact with the heating element support. One or more gaps may be provided between the heating coil and the heating element support. By providing a gap between a coil turn and the support, liquid can be wicked into the gap and held in the gap for vaporization. In particular, liquid can be wicked by the spaces between coil turns and into the gap between a coil turn and the support.

The vaporizer may further comprise a vaporization cavity such that, in use, the vaporization cavity is a negative pressure cavity. At least part of the heating element may be inside the vaporization cavity. By having the heating element in the vaporization cavity, which in turn is a negative pressure cavity when a user inhales through the electronic cigarette, the liquid is directly vaporized and inhaled by the user.

The electronic vapor provision device may comprise a mouthpiece section and the vaporizer may form part of the mouthpiece section. Moreover, the liquid store may form part of the mouthpiece section. For example, the liquid store may substantially fill the mouthpiece section.

Referring to FIG. 1 there is shown an embodiment of the electronic vapor provision device 1 in the form of an electronic cigarette 1 comprising a mouthpiece 2 and a body 3. The electronic cigarette 1 is shaped like a conventional cigarette having a cylindrical shape. The mouthpiece 2 has an air outlet 4 and the electronic cigarette 1 is operated when a user places the mouthpiece 2 of the electronic cigarette 1 in their mouth and inhales, drawing air through the air outlet 4. Both the mouthpiece 2 and body 3 are cylindrical and are configured to connect to each other coaxially so as to form the conventional cigarette shape.

Figure 2:
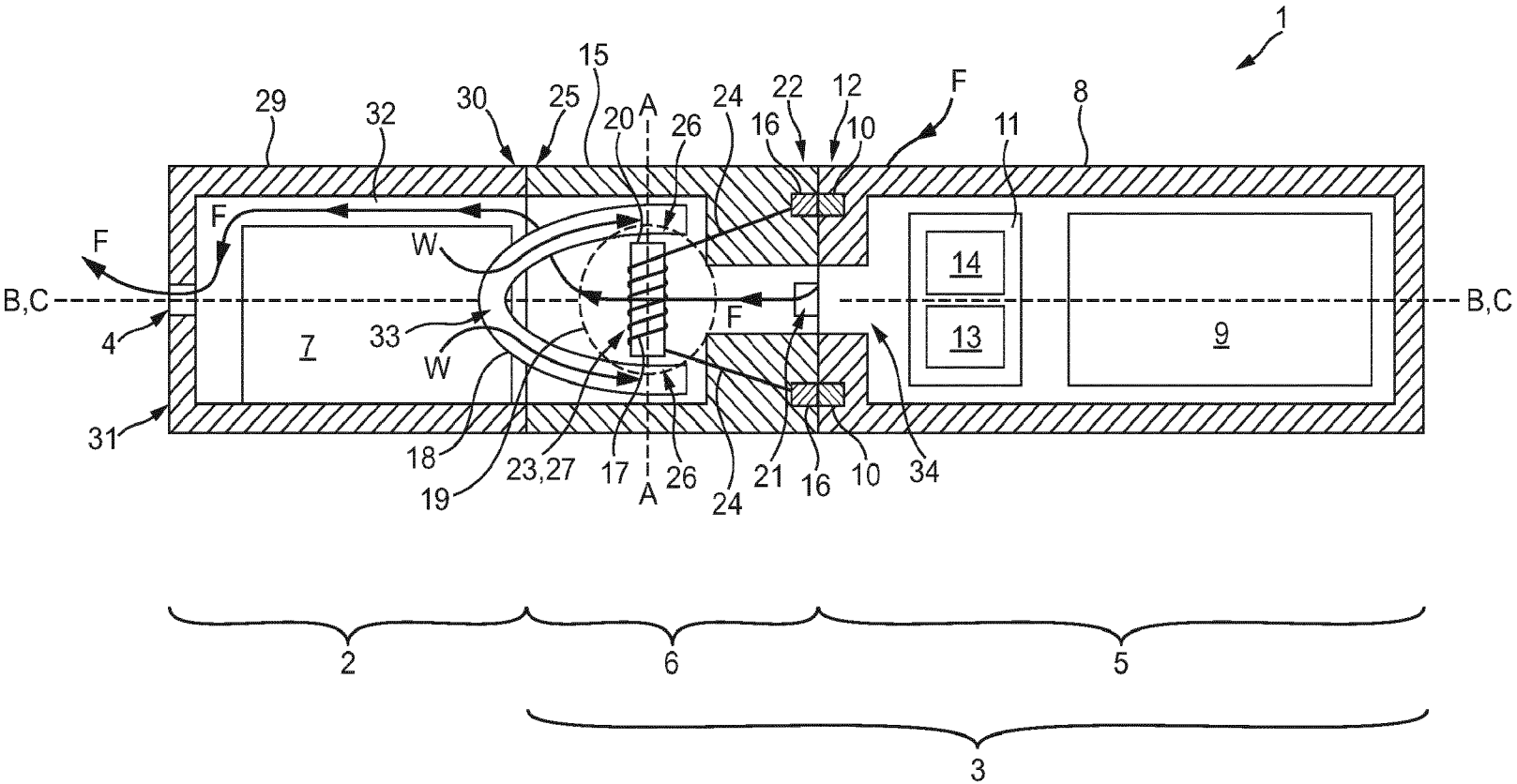
FIG. 2 is a schematic sectional view of an electronic cigarette having a perpendicular coil.

FIG. 2 shows an example of the electronic cigarette 1 of FIG. 1. The body 3 comprises two detachable parts, comprising a battery assembly 5 part and a vaporizer 6 part, and the mouthpiece 2 comprises a liquid store 7. The electronic cigarette 1 is shown in its assembled state, wherein the detachable parts 2, 5, 6 are connected in the following order: mouthpiece 2, vaporizer 6, battery assembly 5. Liquid wicks from the liquid store 7 to the vaporizer 6. The battery assembly 5 provides electrical power to the vaporizer 6 via mutual electrical contacts of the battery assembly 5 and the vaporizer 6. The vaporizer 6 vaporizes the wicked liquid and the vapor passes out of the air outlet 4. The liquid may for example comprise a nicotine solution.

The battery assembly 5 comprises a battery assembly casing 8, a power cell 9, electrical contacts 10 and a control circuit 11.

The battery assembly casing 8 comprises a hollow cylinder which is open at a first end 12. For example, the battery assembly casing 8 may be plastic. The electrical contacts 10 are located at the first end 12 of the casing 8, and the power cell 9 and control circuit 11 are located within the hollow of the casing 8. The power cell 9 may for example be a Lithium Cell.

The control circuit 11 includes an air pressure sensor 13 and a controller 14 and is powered by the power cell 9. The controller 14 is configured to interface with the air pressure sensor 13 and to control provision of electrical power from the power cell 9 to the vaporizer 6.

The vaporizer 6 comprises a vaporizer casing 15, electrical contacts 16, a heating element 17, a wicking element 18, a vaporization cavity 19 and a heating element support 20.

The vaporizer casing 15 comprises a hollow cylinder which is open at both ends with an air inlet 21. For example, the vaporizer casing 15 may be formed of an aluminum alloy. The air inlet 21 comprises a hole in the vaporizer casing 15 at a first end 22 of the vaporizer casing 15. The electrical contacts 16 are located at the first end 22 of the vaporizer casing 15.

The first end 22 of the vaporizer casing 15 is releasably connected to the first end 12 of the battery assembly casing 8, such that the electrical contacts 16 of the vaporizer are electrically connected to the electrical contacts 10 of the battery assembly. For example, the device 1 may be configured such that the vaporizer casing 15 connects to the battery assembly casing 8 by a threaded connection.

Figure 4:
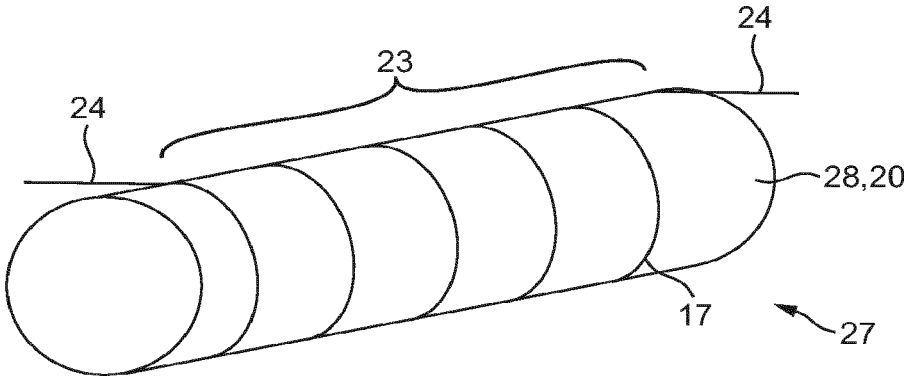
FIG. 4 is a side perspective view of a porous heating element support and a coil.
Figure 5:
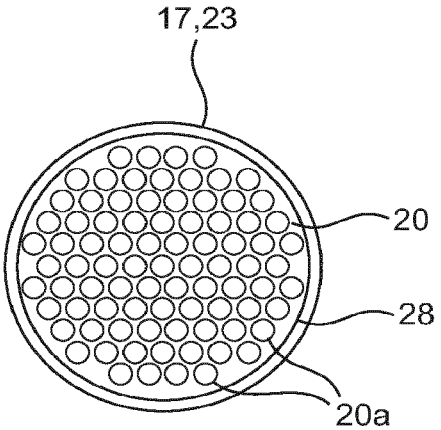
FIG. 5 is an end view of a porous heating element support and a coil.

The heating element 17 is formed of a single wire and comprises a heating element coil 23 and two leads 24, as is illustrated in FIGS. 4 and 5. For example, the heating element may be formed of Nichrome. The coil 23 comprises a section of the wire where the wire is formed into a helix about an axis A. At either end of the coil 23, the wire departs from its helical form to provide the leads 24. The leads 24 are connected to the electrical contacts 16 and are thereby configured to route electrical power, provided by the power cell 9, to the coil 23.

The wire of the coil 23 is approximately 0.12 mm in diameter. The coil is approximately 25 mm in length, has an internal diameter of approximately 1 mm and a helix pitch of approximately 420 micrometers. The void between the successive turns of the coil 23 is therefore approximately 300 micrometers.

The heating element 17 is located towards the second end 25 of the vaporizer casing 15 and is orientated such that the axis A of the coil 23 is perpendicular to the cylindrical axis B of the vaporizer casing 15. The coil 23 of the heating element 17 is thus perpendicular to the longitudinal axis C of the electronic cigarette 1.

The wicking element 18 extends from the vaporizer casing 15 into contact with the liquid store 7 of the mouthpiece 2. The wicking element 18 is configured to wick liquid in the direction W from the liquid store 7 of the mouthpiece 2 to the heating element 17. In more detail, the wick 18 comprises an arc of porous material extending from a first end of the coil 23, out past the second end 25 of the vaporizer casing 14 and back to a second end of the coil. For example, the porous material may be nickel foam, wherein the porosity of the foam is such that the described wicking occurs.

The vaporization cavity 19 comprises a region within the hollow of the vaporizer casing 15 in which liquid is vaporized. The heating element 17, heating element support 20 and portions 26 of the wicking element 18 are situated within the vaporization cavity 19.

Figure 3:
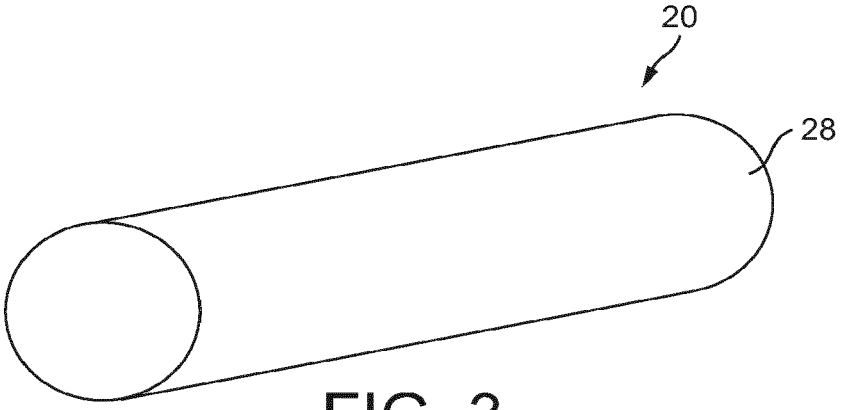
FIG. 3 is a side perspective view of a porous heating element support.

The heating element support 20 is configured to support the heating element 17 and to facilitate vaporization of liquid by the heating element 17. The heating element support 20 is an inner support and is illustrated in FIGS. 3, 4 and 5. The support 20 comprises a rigid cylinder of porous ceramic material. For example, the porous ceramic material is shown to have pores 20*a* distributes throughout the material. The support 20 is situated coaxially within the helix of the heating element coil 23 and is slightly longer than the coil 23, such that the ends of the support 20 protrude from the ends of the coil 23. The diameter of the cylindrical support 20 is similar to the inner diameter of the helix. As a result, the wire of the coil 23 is substantially in contact with the support 20 and is thereby supported, facilitating maintenance of the shape of the coil 23. The heating element coil 23 is thus coiled, or wrapped, around the heating element support 20. The solidity provides a stable and secure structure to hold the coil 23 in place. The combination of the support 20 and the coil 23 of the heating element 17 provides a heating rod 27, as illustrated in FIGS. 4 and 5. The heating rod is later described in more detail with reference to FIGS. 4 and 5.

The surface 28 of the support 20 provides a route for liquid from the wick element 18 to wick onto and along, improving the provision of liquid to the vicinity of the heating element 17 for vaporization. The surface 28 of the support 20 also provides surface area for exposing wicked liquid to the heat of the heating element 17. The porosity of the support allows liquid to be stored in the heating element support 20. The support is thus a further liquid store.

The mouthpiece 2 comprises a mouthpiece casing 29. The mouthpiece casing 29 comprises a hollow cylinder which is open at a first end 30, with the air outlet 4 comprising a hole in the second end 31 of the casing. For example, the mouthpiece casing may be formed of plastic.

The liquid store 7 is situated within the hollow of the mouthpiece casing 29. For example, the liquid store may comprise foam, wherein the foam is substantially saturated in the liquid intended for vaporization. The cross-sectional area of the liquid store 7 is less than that of the hollow of the mouthpiece casing so as to form an air passageway 32 between the first end 30 of the mouthpiece casing 2 and the air outlet 4.

The first end 30 of the mouthpiece casing 29 is releasably connected to the second end 25 of the vaporizer casing 15, such that the liquid store 7 is in contact with a portion 33 of the wicking element 18 which protrudes from the vaporizer 6.

Liquid from the liquid store 7 is absorbed by the wicking element 18 and wicks along route W throughout the wicking element 18. Liquid then wicks from the wicking element 18 onto and along the coil 23 of the heating element 17, and onto and along the support 20.

There exists a continuous inner cavity 34 within the electronic cigarette 1 formed by the adjacent hollow interiors' of the mouthpiece casing 29, the vaporizer casing 15 and the battery assembly casing 8.

In use, a user sucks on the second end 31 of the mouthpiece 2. This causes a drop in the air pressure throughout the inner cavity 34 of the electronic cigarette 1, particularly at the air outlet 4.

The pressure drop within the inner cavity 34 is detected by the pressure sensor 13. In response to detection of the pressure drop by the pressure sensor, the controller 14 triggers the provision of power from the power cell 9 to the heating element 17 via the electrical contacts 10, 16. The coil of the heating element 17 therefore heats up. Once the coil 17 heats up, liquid in the vaporization cavity 19 is vaporized. In more detail, liquid on the heating element 17 is vaporized, liquid on the heating element support 20 is vaporized and liquid in portions 26 of the wicking element 18 which are in the immediate vicinity of the heating element 17 may be vaporized.

The pressure drop within the inner cavity 34 also causes air from outside of the electronic cigarette 1 to be drawn, along route F, through the inner cavity from the air inlet 21 to the air outlet 4. As air is drawn along route F, it passes through the vaporization cavity 19 and the air passageway 32. The vaporized liquid is therefore conveyed by the air movement along the air passageway 32 and out of the air outlet 4 to be inhaled by the user. In passing through the vaporization cavity, along route F, the air moves over the heating element 17 in a direction substantially perpendicular to the axis A of the coil 23.

As the air containing the vaporized liquid is conveyed to the air outlet 4, some of the vapor may condense, producing a fine suspension of liquid droplets in the airflow. Moreover, movement of air through the vaporizer 6 as the user sucks on the mouthpiece 2 can lift fine droplets of liquid off of the wicking element 18, the heating element 17 and/or the heating element support 20. The air passing out of the outlet may therefore comprise an aerosol of fine liquid droplets as well as vaporized liquid.

The pressure drop within the vaporization cavity 19 also encourages further wicking of liquid from the liquid store 7, along the wicking element 18, to the vaporization cavity 19.

Figure 6:
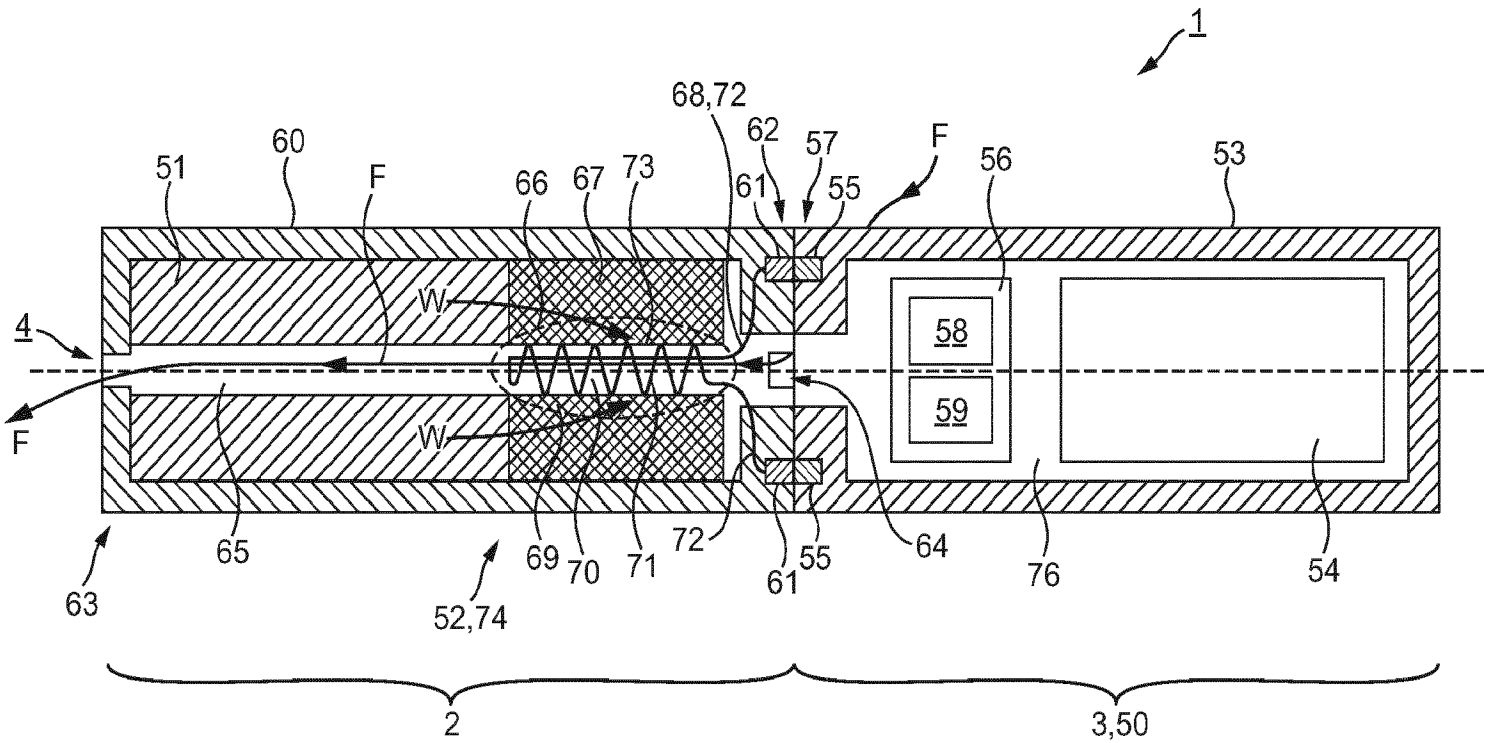
FIG. 6 is a schematic sectional view of an electronic cigarette having a parallel coil.

FIG. 6 shows a further example of the electronic cigarette 1 of FIG. 1. The body 3 is referred to herein as a battery assembly 50, and the mouthpiece 2 includes a liquid store 51 and a vaporizer 52. The electronic cigarette 1 is shown in its assembled state, wherein the detachable parts 2, 3 are connected. Liquid wicks from the liquid store 51 to the vaporizer 52. The battery assembly 50 provides electrical power to the vaporizer 52 via mutual electrical contacts of the battery assembly 50 and the mouthpiece 2. The vaporizer 52 vaporizes the wicked liquid and the vapor passes out of the air outlet 4. The liquid may for example comprise a nicotine solution.

The battery assembly 50 comprises a battery assembly casing 53, a power cell 54, electrical contacts 55 and a control circuit 56.

The battery assembly casing 53 comprises a hollow cylinder which is open at a first end 57. For example, the battery assembly casing 53 may be plastic. The electrical contacts 55 are located at the first end 57 of the casing 53, and the power cell 54 and control circuit 56 are located within the hollow of the casing 53. The power cell 54 may for example be a Lithium Cell.

The control circuit 56 includes an air pressure sensor 58 and a controller 59 and is powered by the power cell 54. The controller 59 is configured to interface with the air pressure sensor 58 and to control provision of electrical power from the power cell 54 to the vaporizer 52, via the electrical contacts 55.

The mouthpiece 2 further includes a mouthpiece casing 60 and electrical contacts 61. The mouthpiece casing 60 comprises a hollow cylinder which is open at a first end 62, with the air outlet 4 comprising a hole in the second end 63 of the casing 60. The mouthpiece casing 60 also comprises an air inlet 64, comprising a hole near the first end 62 of the casing 60. For example, the mouthpiece casing may be formed of aluminum.

The electrical contacts 61 are located at the first end of the casing 60. Moreover, the first end 62 of the mouthpiece casing 60 is releasably connected to the first end 57 of the battery assembly casing 53, such that the electrical contacts 61 of the mouthpiece 2 are electrically connected to the electrical contacts 55 of the battery assembly 50. For example, the device 1 may be configured such that the mouthpiece casing 60 connects to the battery assembly casing 53 by a threaded connection.

The liquid store 51 is situated within the hollow mouthpiece casing 60 towards the second end 63 of the casing 60. The liquid store 51 comprises a cylindrical tube of porous material saturated in liquid. The outer circumference of the liquid store 51 matches the inner circumference of the mouthpiece casing 60. The hollow of the liquid store 51 provides an air passageway 65. For example, the porous material of the liquid store 51 may comprise foam, wherein the foam is substantially saturated in the liquid intended for vaporization.

The vaporizer 52 comprises a vaporization cavity 66, a heating element support 67 and a heating element 68.

The vaporization cavity 66 comprises a region within the hollow of the mouthpiece casing 60 in which liquid is vaporized. The heating element 68 and a portion 69 of the support 67 are situated within the vaporization cavity 66.

Figure 7:
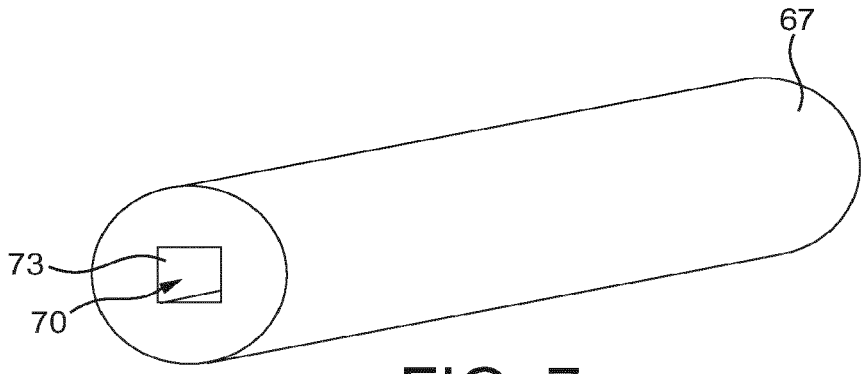
FIG. 7 is a side perspective view of an outer porous heating element support.
Figure 8:
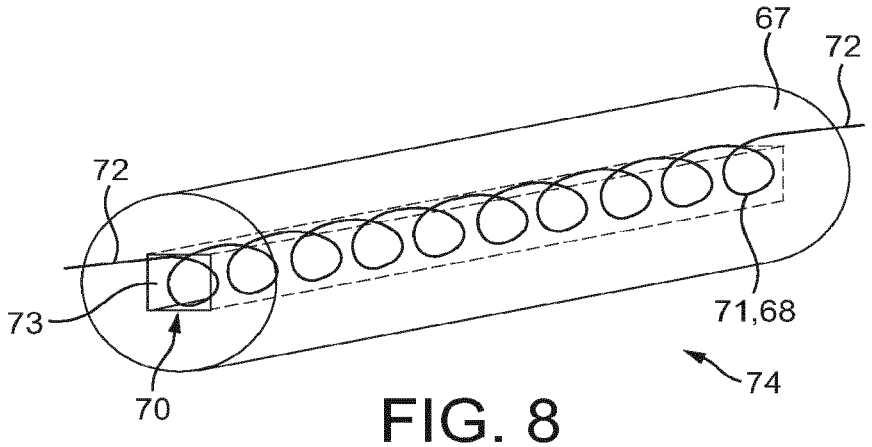
FIG. 8 is a side perspective view of an outer porous heating element support and a coil.
Figure 9:
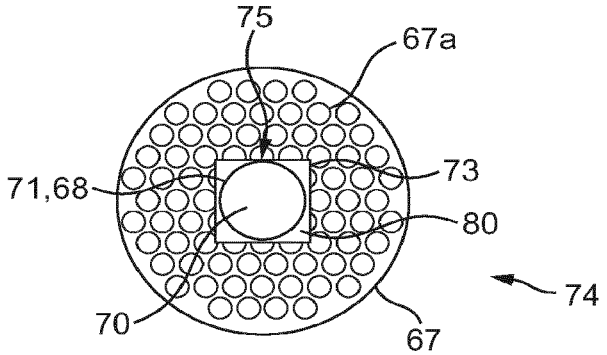
FIG. 9 is an end view of an outer porous heating element support and a coil.

The heating element support 67 is configured to support the heating element 68 from the outside and to facilitate vaporization of liquid by the heating element 68 and is illustrated in FIGS. 7 to 9. Because the support 67 is located outside of the heating element 68, its size is not restricted by the size of the heating element, and so can be much larger than those of the embodiments described above. This facilitates the storing of more liquid by the porous heating element support 67 than those of the embodiments described above. The support 67 comprises a hollow cylinder of rigid, porous material and is situated within the mouthpiece casing 60, towards the first end 62 of the casing 60, such that it abuts the liquid store 51. The porous material has pores 67*a* distributes throughout. The outer circumference of the support 67 matches the inner circumference of the mouthpiece casing 60. The hollow of the support comprises a longitudinal, central channel 70 through the length of the support 67. The channel 70 has a square cross-sectional shape, the cross-section being perpendicular to the longitudinal axis of the support. The support 67 acts as a wicking element, as it is configured to wick liquid in the direction W from the liquid store 51 of the mouthpiece 2 to the heating element 68. For example, the porous material of the support 67 may be nickel foam, wherein the porosity of the foam is such that the described wicking occurs. Once liquid wicks W from the liquid store 51 to the support 67, it is stored in the porous material of the support 67. Thus, the support 67 is an extension of the liquid store 51.

The heating element 68 is formed of a single wire and comprises a heating element coil 71 and two leads 72, as is illustrated in FIGS. 8 and 9. For example, the heating element 68 may be formed of Nichrome. The coil 71 comprises a section of the wire where the wire is formed into a helix about an axis A. At either end of the coil 71, the wire departs from its helical form to provide the leads 72. The leads 72 are connected to the electrical contacts 61 and are thereby configured to route electrical power, provided by the power cell 54, to the coil 71.

The wire of the coil 71 is approximately 0.12 mm in diameter. The coil is approximately 25 mm in length, has an internal diameter of approximately 1 mm and a helix pitch of approximately 420 micrometers. The void between the successive turns of the coil 71 is therefore approximately 300 micrometers.

The coil 71 of the heating element 68 is located coaxially within the channel 70 of the support. The heating element coil 71 is thus coiled within the channel 70 of the heating element support 67. Moreover, the axis A of the coil 71 is thus parallel to the cylindrical axis B of the mouthpiece casing 60 and the longitudinal axis C of the electronic cigarette 1.

The coil 71 is the same length as the support 67, such that the ends of the coil 71 are flush with the ends of the support 67. The outer diameter of the helix of the coil 71 is similar to the cross-sectional width of the channel 70. As a result, the wire of the coil 71 is in contact with the surface 73 of the channel 70 and is thereby supported, facilitating maintenance of the shape of the coil 71. Each turn of the coil is in contact with the surface 73 of the channel 70 at a contact point 75 on each of the four walls 73 of the channel 70. The combination of the coil 71 and the support 67 provides a heating rod 74, as illustrated in FIGS. 8 and 9. The heating rod 74 is later described in more detail with reference to FIGS. 8 and 9.

The inner surface 73 of the support 67 provides a surface for liquid to wick onto the coil 71 at the points 75 of contact between the coil 71 and the channel 70 walls 73. The inner surface 73 of the support 67 also provides surface area for exposing wicked liquid to the heat of the heating element 68.

There exists a continuous inner cavity 76 within the electronic cigarette 1 formed by the adjacent hollow interiors' of the mouthpiece casing 60 and the battery assembly casing 53.

In use, a user sucks on the second end 63 of the mouthpiece casing 60. This causes a drop in the air pressure throughout the inner cavity 76 of the electronic cigarette 1, particularly at the air outlet 4.

The pressure drop within the inner cavity 76 is detected by the pressure sensor 58. In response to detection of the pressure drop by the pressure sensor 58, the controller 59 triggers the provision of power from the power cell 54 to the heating element 68 via the electrical contacts 55, 26. The coil of the heating element 68 therefore heats up. Once the coil 17 heats up, liquid in the vaporization cavity 66 is vaporized. In more detail, liquid on the coil 71 is vaporized, liquid on the inner surface 73 of the heating element support 67 is vaporized and liquid in the portions 22 of the support 67 which are in the immediate vicinity of the heating element 68 may be vaporized.

The pressure drop within the inner cavity 76 also causes air from outside of the electronic cigarette 1 to be drawn, along route F, through the inner cavity from the air inlet 64 to the air outlet 4. As air is drawn along route F, it passes through the vaporization cavity 66, picking up vaporized liquid, and the air passageway 65. The vaporized liquid is therefore conveyed along the air passageway 65 and out of the air outlet 4 to be inhaled by the user. In passing through the vaporization cavity, along route F, the air moves over the heating element 68 in a direction substantially parallel to the axis A of the coil 71.

As the air containing the vaporized liquid is conveyed to the air outlet 4, some of the vapor may condense, producing a fine suspension of liquid droplets in the airflow. Moreover, movement of air through the vaporizer 52 as the user sucks on the mouthpiece 2 can lift fine droplets of liquid off of the heating element 68 and/or the heating element support 67. The air passing out of the air outlet 4 may therefore comprise an aerosol of fine liquid droplets as well as vaporized liquid.

With reference to FIGS. 8 and 9, due to the cross-sectional shape of the channel, gaps 80 are formed between the inner surface 73 of the heating element support 67 and the coil 71. In more detail, where the wire of the coil 71 passes between contact points 75, a gap 80 is provided between the wire and the area of the inner surface 73 closest to the wire due to the wire substantially maintaining its helical form. The distance between the wire and the surface 73 at each gap 80 is in the range of 10 micrometers to 500 micrometers. The gaps 80 are configured to facilitate the wicking of liquid onto the coil 71 through capillary action at the gaps 80. The gaps 80 also provide areas in which liquid can gather prior to vaporization, and thereby provide areas for liquid to be stored prior to vaporization. The gaps 80 also expose more of the coil 71 for increased vaporization in these areas.

Many alternatives and variations to the embodiments described above are possible. For example, alternatives and variations to the embodiments of FIGS. 2 to 5 are as follows.

Figure 10:
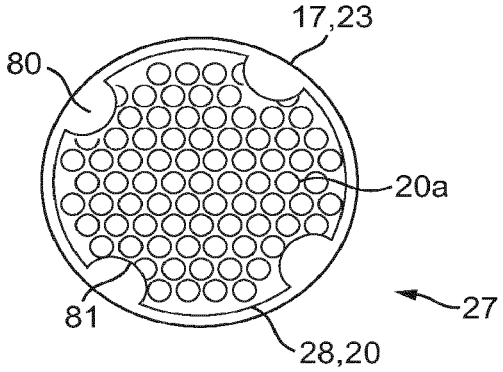
FIG. 10 is an end view of a porous heating element support with channels, and a coil.
Figure 11:
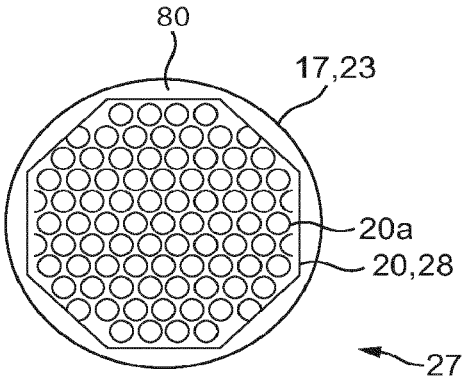
FIG. 11 is an end view of a porous heating element support having an octagonal cross-sectional shape, and a coil.
Figure 12:
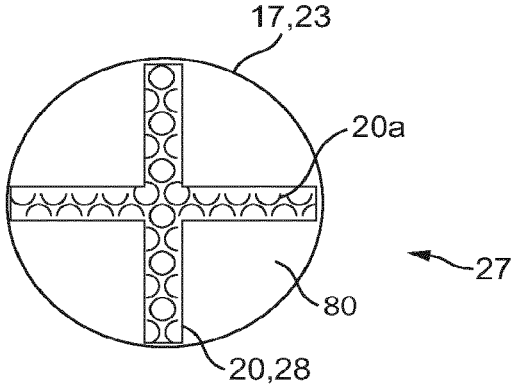
FIG. 12 is an end view of a porous heating element support having a four arm cross cross-sectional shape, and a coil.

FIGS. 10 to 12 show other examples of porous heating element supports 20 with a coil 23 wound around. These differ from the example shown in FIGS. 2 to 5 and from each other by the shape of the heating element support 20. In each of the examples of FIGS. 10 to 12, gaps 80 are provided between the heating element 17 and the support 20 by virtue of the cross-sectional shape of the support. In more detail, where the wire of the coil 23 passes over a depression in the surface 28, a gap 80 is provided between the wire and the area of the surface 28 immediately under the wire due to the wire substantially maintaining its helical form. The gaps 80 are therefore disposed in a radial direction from the axis A of the coil, between the surface 28 of the support 20 and the wire of the coil 23. The distance between the wire and the surface 28 at each gap 80 is in the range of 10 micrometers to 500 micrometers. The gaps 80 are configured to facilitate the wicking of liquid onto and along the length of the support 20 through capillary action at the gaps 80. As with the heating rods of FIGS. 8 and 9, the gaps 80 also facilitate the wicking of liquid onto the heating element 17 from the porous support 20 through capillary action at the gaps 80. The gaps 80 also provide areas in which liquid can gather on the surface 28 of the support 20 prior to vaporization, and thereby provide areas for liquid to be stored prior to vaporization. The gaps 80 also expose more of the coil 23 for increased vaporization in these areas.

FIG. 10 shows a heating element support 20 having a generally cylindrical shape but having four surface channels 81 running lengthwise and spaced equally around the support 20. The coil 23 is wound around the support 20 and gaps 80 are provided where the coil turns overlap the channels 81. In more detail, where the wire of the coil 23 passes over a channel 81, a gap 80 is provided between the wire and the area of the surface 28 immediately under the wire.

The heating element support 20 is porous and stores liquid. The gaps 80 provided by the channels 81 have two functions. Firstly, they provide a means for liquid to be wicked both onto the coil 23 and into the heating element support 20 by capillary action. Secondly, they expose the coil 23 surface in the area of the channels 81 thereby increasing the vaporization surface of the coil 23.

In FIG. 11, the heating element support 20 has an octagonal outer cross-sectional shape, perpendicular to the lengthwise direction. The coil 23 is wound around this support. Because the coil 23 is wire of some rigidity, the wire form does not match the exact outer form of the support, but tends to be curved. Thus, gaps 80 provided between the outer octagonal surface of the heating element support 20 and the curved coil 23.

Again, the heating element support 20 is porous for liquid storage and the gaps 80 provide a means of wicking liquid onto the coil 23, and expose a greater surface of the Coil 23 for increased vaporization.

In FIG. 12, the heating element support 20 has an outer cross-sectional shape equal to a four arm cross. The coil 23 is wound around the support 20 and gaps 80 are provided between respective arms and the coil 23 surface. These gaps 80 provide the same advantages already described.

Moreover, where channels 81 are provided in the heating element support 20, a number other than one or four channels 81 can be used.

Furthermore, channels 81 have been described as longitudinal grooves along the surface 28 of cylindrical supports 20. However, the channels 81 may, for example, alternatively or additionally comprise helical grooves in the surface 28 of a cylindrical support 20, spiraling about the axis of the support. Alternatively or additionally the channels 81 may comprise circumferential rings around the surface 28 of the support 20.

In embodiments, the inner support 20 is described as being slightly longer than the coil 23, such that it protrudes from either end of the coil 23. Alternatively, the support 20 may be shorter in length than the coil 23 and may therefore reside entirely within the bounds of the coil.

Figure 13:
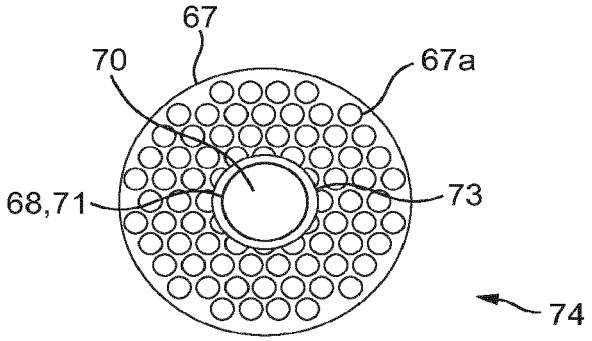
FIG. 13 is an end view of an outer porous heating element support and a coil.
Figure 14:
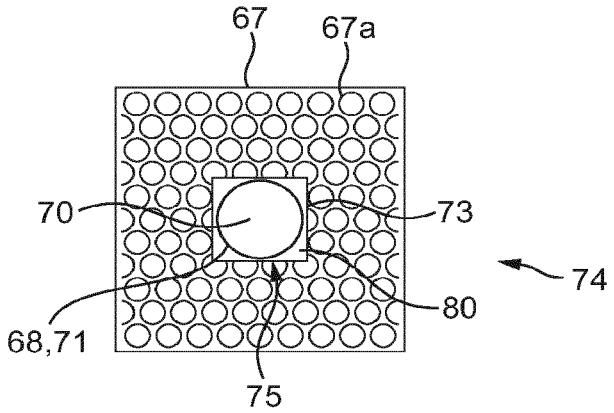
FIG. 14 is an end view of an outer porous heating element support and a coil.
Figure 15:
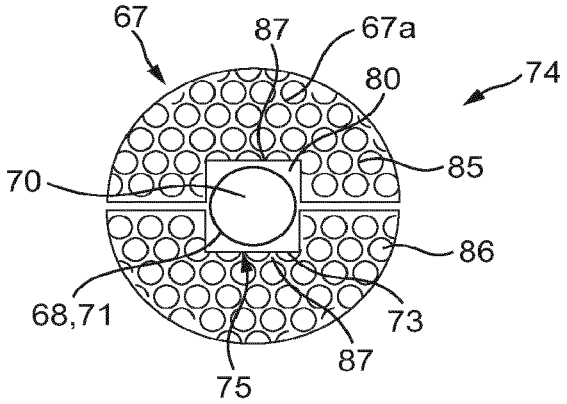
FIG. 15 is an end view of a two part outer porous heating element support and a coil.

Furthermore, example alternatives and variations to the embodiments of FIGS. 6 to 9 are as follows. FIGS. 13 to 15 show other examples of outer porous heating element supports 67 with an internal coil 71. These differ from the example shown in FIGS. 7 and 9 and from each other by the shape of the heating element support 67.

FIG. 13 shows a device similar to that shown in FIG. 9 with the exception that the internal channel 70 has a circular cross-sectional shape rather than a square. This provides an arrangement where a coil 71 is fitted into the internal channel 70 and is in contact with the channel 70 surface along the length of the channel 70 substantially without gaps in the contact areas. This extra contact provides an increased means for liquid to be wicked onto the coil 71 and a general decrease in the vaporization area of the coil 71.

In FIG. 14 a device is shown similar to that shown in FIG. 9. In this example, the outer cross-sectional shape of the heating element support 67 is a square rather than a circle.

FIG. 15 shows a heating element support 67 comprising a first support section 85 and a second support section 86. The heating element support 67 is generally cylindrical in shape and the first support section 85 and second support section 86 are half cylinders with generally semi-circular cross-sections, which are joined together to form the cylindrical shape of the heating element support 67.

The first support section 85 and second support section 86 each have a side channel 87, or groove 87, running along their respective lengths, along the middle of their otherwise flat longitudinal surfaces. When the first support section 85 is joined to the second support section 86 to form the heating element support 67, their respective side channels 87 together form the heating elements support 67 internal channel 70.

In this example, the combined side channels 87 form an internal channel 70 having a square cross-sectional shape. Thus, the side channels 87 are each rectangular in cross-section. The coil 71 is situated within the heating element support 67 internal channel 70. Having a heating element support 67 that comprises two separate parts 85, 86 facilitates manufacture of this component. During manufacturing, the coil 71 can be fitted into the side channel 87 of the first support section 85, and the second support section 86 can be placed on top to form the completed heating element support 67.

Internal support channels 70 with cross-sectional shapes other than those described could be used.

Moreover, the coil 71 may be shorter in length than the outer support 67 and may therefore reside entirely within the bounds of the support. Alternatively, the coil 71 may be longer than the outer support 67.

In embodiments, the support 67 may be located partially or entirely within liquid store 51. For example, the support 67 may be located coaxially within the tube of the liquid store 51.

Furthermore, example alternatives and variations to the embodiments described above are as follows.

An electronic vapor provision device comprising an electronic cigarette 1 is described herein. However, other types of electronic vapor provision device are possible.

The wire of the coil 23, 71 is described above as being approximately 0.12 mm thick. However, other wire diameters are possible. For example, the diameter of the coil wire may be in the range of 0.05 mm to 0.2 mm. Moreover, the coil 23, 71 length may be different to that described above. For example, the coil 23, 71 length may be in the range of 20 mm to 40 mm.

The internal diameter of the coil 23, 71 may be different to that described above. For example, the internal diameter of the coil 23, 71 may be in the range of 0.5 mm to 2 mm.

The pitch of the helical coil 23, 71 may be different to that described above. For example, the pitch may be between 120 micrometers and 600 micrometers.

Furthermore, although the distance of the voids between turns of the coil 23, 71 is described above as being approximately 300, different void distances are possible. For example, the void may be between 20 micrometers and 500 micrometers.

The size of the gaps 80 may be different to that described above.

Furthermore, the electronic vapor provision device 1 is not restricted to the sequence of components described and other sequences could be used such as the control circuit 11, 56 being in the tip of the device or the liquid store 7, 51 being in the electronic vapor provision device 1 body 3 rather than the mouthpiece 2.

The electronic vapor provision device 1 of FIG. 2 is described as comprising three detachable parts, the mouthpiece 2, the vaporizer 6 and the battery assembly 5. Alternatively, the electronic vapor provision device 1 may be configured such these parts 2, 6, 5 are combined into a single integrated unit. In other words, the mouthpiece 2, the vaporizer 6 and the battery assembly 5 may not be detachable. As a further alternative, the mouthpiece 2 and the vaporizer 6 may comprise a single integrated unit, or the vaporizer 6 and the battery assembly 5 may comprise a single integrated unit.

The electronic vapor provision device 1 of FIG. 6 is described as comprising two detachable parts, the mouthpiece 2 and the body comprising the battery assembly 50. Alternatively, the device 1 may be configured such these parts 2, 50 are combined into a single integrated unit. In other words, the mouthpiece 2 and the body 3 may not be detachable.

The heating element 17, 68 is not restricted to being a coil 23, 71, and may be another wire form such as a zig-zag shape.

An air pressure sensor 13, 58 is described herein. In embodiments, an airflow sensor may be used to detect that a user is sucking on the device.

The heating element 17, 68 is not restricted to being a uniform coil.

The porous material of the heating element support 20, 67 may be optimized for retention and wicking of certain liquids. For example the porous material may be optimized for the retention and wicking of a nicotine solution. For instance, the nicotine solution may be liquid containing nicotine diluted in a propylene glycol solution.

The heating element support 20, 67 is not limited to being a porous ceramic and other solid porous materials could be used such as porous plastics materials or solid foams.

Reference herein to a vaporization cavity 19, 66 may be replaced by reference to a vaporization region.

Although examples have been shown and described, it will be appreciated by those skilled in the art that various changes and modifications might be made without departing from the scope of the invention.

In order to address various issues and advance the art, the entirety of this disclosure shows by way of illustration various embodiments in which the claimed invention(s) may be practiced and provide for superior electronic vapor provision. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future. Any feature of any embodiment can be used independently of, or in combination with, any other feature

The invention claimed is:

1. An electronic vapor provision device comprising:

a heating element for vaporizing liquid, the heating element being a zig-zag shape;

an air outlet for vaporized liquid from the heating element; and a heating element support, wherein the heating element support is porous and comprises a ceramic material, the heating element being supported by the heating element support.

2. An electronic vapor provision device according to claim 1, wherein the ceramic material is a rigid porous ceramic material.

3. An electronic vapor provision device according to claim 1, wherein the ceramic material is a solid porous ceramic material.

4. An electronic vapor provision device according to claim 1, wherein the ceramic material comprises pores of substantially equal size.

5. An electronic vapor provision device according to claim 1, wherein the ceramic material comprises pores distributed evenly throughout the ceramic material.

6. An electronic vapor provision device according to claim 1, wherein the ceramic material comprises smaller pores in a region next to the heating element and larger pores further from the heating element.

7. An electronic vapor provision device according to claim 1, wherein the ceramic material comprises a gradient of pore sizes ranging from smaller pores next to the heating element to larger pores further from the heating element.

8. An electronic vapor provision device according to claim 1, wherein the ceramic material is configured such that a majority of the material volume comprises open pores for liquid storage.

9. An electronic vapor provision device according to claim 1, wherein the heating element support is a store of liquid.

10. An electronic vapor provision device according to claim 9, wherein the store of liquid is sealed on at least part of an outer surface region to inhibit porosity in that region.

11. An electronic vapor provision device according to claim 1, wherein the ceramic material is optimized for liquid retention and wicking.

12. An electronic vapor provision according to claim 11, wherein the ceramic material is optimized for liquid glycerine retention and wicking.

13. An electronic vapor provision device according to claim 1, wherein the heating element is supported from its outside by the heating element support.

14. An electronic vapor provision device according to claim 1, wherein the heating element is supported from its inside by the heating element support.

15. An electronic vapor provision device according to claim 1, wherein the electronic vapor provision device is an electronic cigarette.

* * * * *